US007896548B2

(12) United States Patent
Crunkleton et al.

(10) Patent No.: US 7,896,548 B2
(45) Date of Patent: Mar. 1, 2011

(54) DOUBLE GUSSETED SLIDER PACKAGE

(75) Inventors: Gregory H. Crunkleton, Nicholson, GA (US); Basil C. Linton, Loganville, GA (US); Eric J. Fenzl, Loganville, GA (US); Robert C. Stolmeier, Shelbyville, IN (US); Matthew W. Nysted, Kennesaw, GA (US)

(73) Assignee: Illinois Tool Works Inc., Glenview, IL (US)

( * ) Notice: Subject to any disclaimer, the term of this patent is extended or adjusted under 35 U.S.C. 154(b) by 1089 days.

(21) Appl. No.: 11/649,598

(22) Filed: Jan. 4, 2007

(65) Prior Publication Data

US 2008/0166073 A1 Jul. 10, 2008

(51) Int. Cl.

| | |
|---|---|
| ***B65D 33/14*** | (2006.01) |
| ***B65D 33/10*** | (2006.01) |
| ***B65D 30/16*** | (2006.01) |
| ***B65D 30/20*** | (2006.01) |
| ***B65D 33/00*** | (2006.01) |

(52) U.S. Cl. ..... 383/5; 383/9; 383/61.2; 383/64; 383/67; 383/104; 383/120; 383/203

(58) Field of Classification Search ..... 383/63, 383/64, 120, 104, 66, 67, 9, 61.2, 5, 203
See application file for complete search history.

(56) References Cited

U.S. PATENT DOCUMENTS

| | | | | |
|---|---|---|---|---|
| 5,221,143 | A * | 6/1993 | Peppiatt | 383/29 |
| 6,481,183 | B1 * | 11/2002 | Schmidt | 53/412 |
| 6,595,690 | B2 | 7/2003 | Machacek | |
| 6,799,890 | B2 | 10/2004 | Schneider et al. | |
| 6,874,935 | B2 * | 4/2005 | Edelman et al. | 383/5 |
| 6,986,237 | B2 | 1/2006 | Ausnit | |
| 7,182,512 | B2 * | 2/2007 | Bois Henri | 383/5 |
| 7,186,025 | B2 * | 3/2007 | Shepard et al. | 383/120 |
| 7,396,163 | B2 * | 7/2008 | McGregor | 383/204 |
| 2003/0215163 | A1 | 11/2003 | Schneider | |

FOREIGN PATENT DOCUMENTS

| | | |
|---|---|---|
| EP | 1621473 | 2/2006 |
| WO | WO 01/17864 A2 * | 3/2001 |
| WO | WO 01/96194 | 12/2001 |

* cited by examiner

*Primary Examiner* — Jes F Pascua
(74) *Attorney, Agent, or Firm* — Day Pitney LLP

(57) ABSTRACT

The present disclosure relates to a reclosable package or bag with a slider zipper, and further including a first gusset with a perforated line or similar line of weakness formed between the slider zipper profiles in order to provide tamper evidence and a second gusset formed below one zipper profile in order to allow the filled packaged to stand up for display purposes. This package or bag is typically bottom filled, but then displayed to the customer in the orientation with the bottom in the upper position and the zipper in the lower position. One alternative embodiment substitutes a press-to-close-zipper for the slider zipper. A further alternative embodiment omits the perforated line and provides for a separation in the web between the zipper profiles to form a mouth for the package or bag.

16 Claims, 3 Drawing Sheets

DOUBLE GUSSETED SLIDER PACKAGE

BACKGROUND OF THE INVENTION

1. Field of the Invention

The present invention relates to a reclosable package or bag with a slider zipper, and further including a first gusset formed between the zipper profiles in order to provide tamper evidence and a second gusset formed below one zipper profile in order to allow the filled package to stand up for display purposes.

2. Description of the Prior Art

The prior art of reclosable packages or bags is well-developed. However, further developments are always sought in order to make the packages more attractive in a retail environment. A free-standing package can be attractive in this regard. Similarly, gussets can be used to increase capacity of the package or bag. Method for making gussets are disclosed in U.S. Pat. No. 6,986,237 entitled "Methods of Making a Gusset Style Pouch in a Reclosable Bag", issued on Jan. 17, 2006 to Ausnit. Moreover, tamper evidence is generally preferred by consumers. Representative tamper-evident packages or bags are disclosed in U.S. Pat. No. 6,799,890 entitled "Tamper Evident Resealable Packaging", issued on Oct. 5, 2004 to Schneider et al., and U.S. Pat. No. 6,595,690 entitled "Shock Resistant Tamper Evident Reclosable Plastic Bag", issued on Jul. 22, 2003 to Machacek.

OBJECTS AND SUMMARY OF THE INVENTION

It is therefore an object of the present invention to provide a reclosable package or bag which is attractive and has a high capacity, particularly for bakery or similar commercial products.

It is therefore a further object of the present invention to provide a reclosable package or bag which is tamper evident.

These and other objects are attained by providing a reclosable package or bag with two gussets, a first gusset which is formed between the zipper profiles and a second gusset which is formed on one wall immediately below the zipper profile. The first gusset provides a tamper evident feature, and typically includes a perforated line or similar line or area of weakness in the gusset fold. This perforated line or similar element is torn open to gain initial consumer access to the product. The second gusset expands when the package or bag is loaded with product, thereby providing a standing capability for display purposes.

A slider zipper is typically installed over the first gusset. However, an alternative embodiment uses a press-to-close zipper within the first gusset.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENTS

Figure 1:
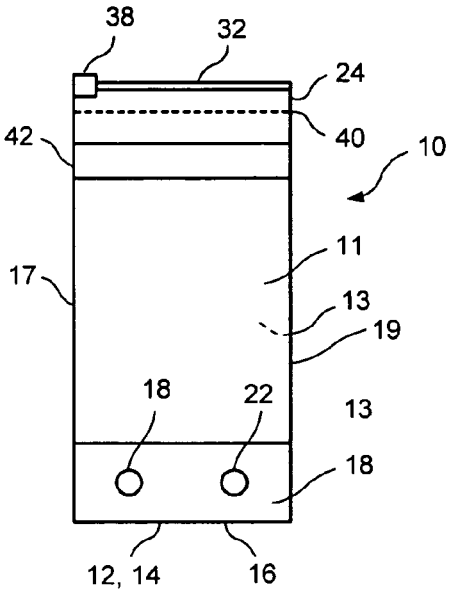
FIG. 1 is a plan view of the package or bag of the present invention, shown in the orientation with the zipper at the top of the package or bag.
Figure 2:
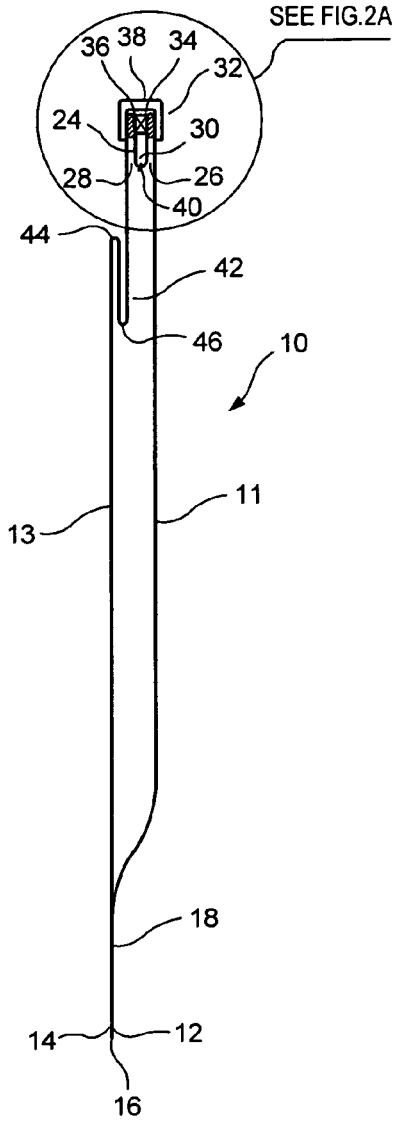
FIG. 2 is a cross-sectional view along plane 2-2 of FIG. 1.

Referring now to the drawings in detail wherein like numerals indicate like elements throughout the several views, one sees that FIG. 1 is a plan view of the package or bag 10 of the present invention, shown in the orientation with the zipper at the top, while FIG. 2 is a cross-sectional view along plane 2-2 of FIG. 1.

Bag 10 is formed from a single sheet of polymeric web forming front wall 11 and rear wall 13 so that the two ends or edges 12, 14 of the web are sealed together at bottom 16 by wide bottom seal 18. Wide seal bottom seal 18 can include hang apertures 20, 22 for hanging on a display (in an inverted position from that shown in FIG. 1). The contents of bag 10 are typically filled between ends or edges 12, 14 before the sealing together thereof to form wide bottom seal 18. Side seals 17, 19 are likewise formed between front and rear walls 11, 13.

Top gusset 24 is formed at the top of the bag 10 thereby forming first and second protrusions 26, 28 with top gusset fold 30 therebetween. Zipper 32 includes first and second flanged zipper profiles 34, 36 which are sealed to respective first and second protrusions 26, 28. Slider 38 is mounted on first and second flanged zipper profiles 34, 36 and operates in the conventional manner of interlocking first and second flanged zipper profiles 34, 36 when moved in a first direction and separating interlocking first and second flanged zipper profiles 34, 36 when moved in a second direction.

Perforated line 40 is formed in the web in top gusset fold 30. Perforated line 40 may be replaced by a similar line or area of weakness such as a scored line or a peel seal. The resulting configuration allows a consumer or user to move slider 38 in the second direction to separate the first and second flanged zipper profiles 34, 36 and thereafter break or tear perforated line 40 in order to gain access to the contents of bag 10. The user or consumer may thereafter reclose the bag 10 by moving slider 38 in the first direction. The tearing of perforated line 40 remains, however, as evidence of prior opening. An alternative embodiment could omit perforated line 40 resulting in a gap in the web where perforated line 40 is otherwise formed. This would remove this tamper-evident characteristic. Moreover, it would permit bag 10 to be formed from two separate sheets of web, or formed from a single sheet of web and filled through the zipper 32 (wide bottom seal 18 being formed from two sides of a bottom fold rather than the joining of two ends 12, 14 of web).

Figure 2A:
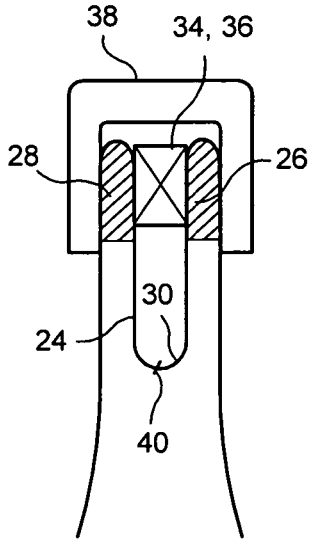
FIG. 2A shows the area of detail from FIG. 2.
Figure 2B:
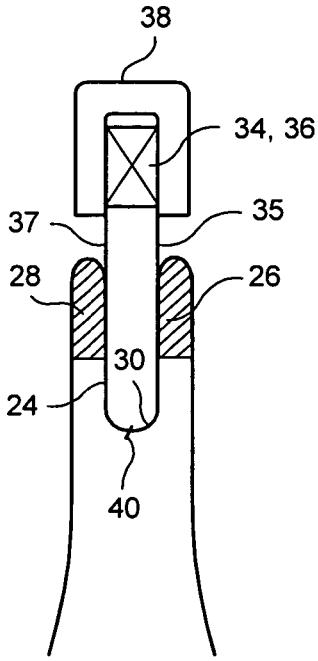
FIG. 2B shows a first alternative area of detail from FIG. 2, wherein the package walls are sealed to an external portion of zipper flanges.
Figure 2C:
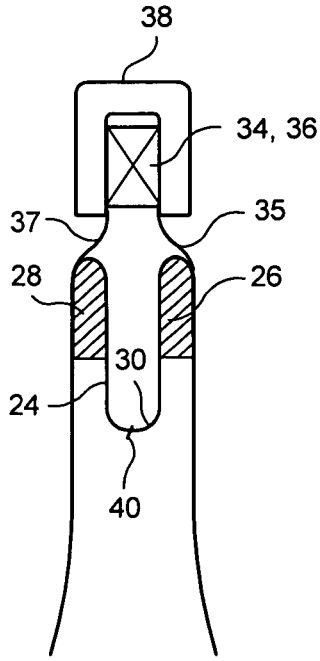
FIG. 2C shows a second alternative area of detail from FIG. 2, wherein the package walls are sealed to an internal portion of zipper flanges.

FIGS. 2B and 2C disclose alternative embodiments wherein first and second zipper profiles 34, 36 include respective first and second zipper flanges 35, 37. In FIG. 2B, the exterior faces of first and second zipper flanges 35, 37 are sealed to the interior of respective first and second protrusions 26, 28. In FIG. 2C, the interior faces of first and second zipper flanges 35, 37 are sealed to the exterior of respective first and second protrusions 26, 28.

Side gusset 42 is formed in the web below second protrusion 28 thereby forming side gusset protrusion 44 and side gusset fold 46. The segments of web forming the side gusset protrusion 44 are sealed together. The resulting seal may form an integral or unified portion of the side seals 17, 19 (typically only for wider packages so that central portions of side gusset protrusion 44 may extend upon filling) or may form a separate protrusion therefrom. Upon loading of product into bag 10, side gusset 42 expands and the side gusset protrusion 44 (either the entire gusset protrusion 44 or, if a portion of is integral with side seals 17, 19, then the central portion of gusset protrusion 44) protrudes thereby providing the bag 10 with the capability of standing in the orientation shown in FIG. 3 (that is, with zipper 30 in the lower position, the opposite of the orientation shown in FIG. 1). Whether the bag 10 is displayed by placing hang apertures 20, 22 on a display rack or by opening the side gusset 42 to form a standing capability, the consumer sees bag 10 in the orientation of FIG. 3, and the graphics on bag 10 should be placed accordingly.

Figure 4:
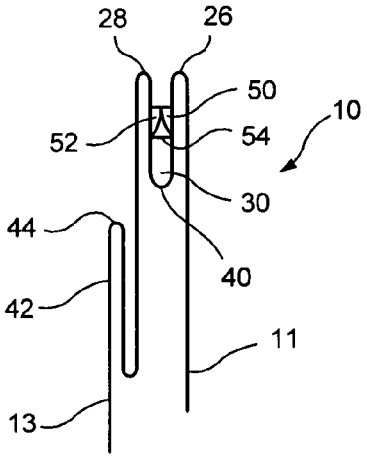
FIG. 4 is a cross-sectional view of an alternative embodiment, using a press-to-close zipper.
Figure 3:
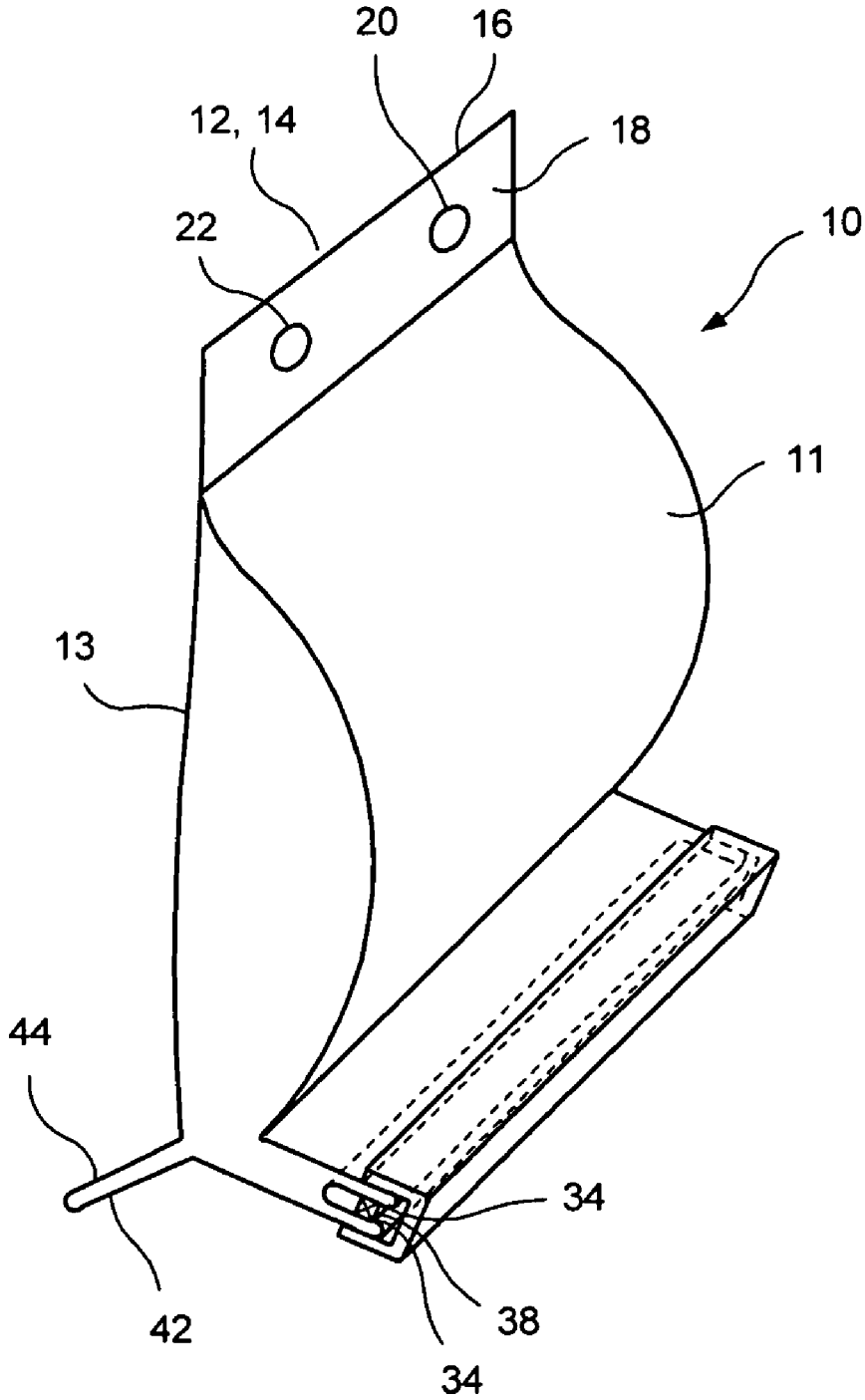
FIG. 3 is a perspective view of the package or bag of the present invention, shown in the orientation with the zipper at the bottom of the package or bag, and the first gusset in the expanded position to provide the standing capability.

FIG. 4 discloses an alternative embodiment of bag 10, with the first and second profiles 50, 52 of a press-to-close zipper 54 placed on the interior of first and second protrusions 26, 28, respectively, within top gusset fold 30. Otherwise, the bag 10 of FIG. 4 is produced with similar or identical elements as shown in FIGS. 1-3.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A reclosable package comprising:

at least one sheet of web forming a first wall and a second wall;

a first gusset formed between the first wall and the second wall, thereby forming a first gusset fold between a first protrusion and a second protrusion;

a slider zipper including a first zipper profile attached to the first protrusion, a second zipper profile attached to the second protrusion, and a slider mounted on the first and second zipper profiles, the slider interlocking the first and second zipper profiles when moved in a first direction and separating the first and second zipper profiles when moved in a second direction;

a second gusset formed in the first wall thereby forming a second gusset fold and a second gusset protrusion; and wherein edges of the first wall and the second wall are brought together at a location opposite the first gusset, product is inserted between the edges of the first wall and the second wall, and a seal formed joining the edges of the first wall and the second wall, wherein the seal is sufficiently wide for at least one hang aperture to be formed therein.

2. The reclosable package of claim 1 wherein the second gusset expands when the reclosable package is filled with product thereby allowing the reclosable package to stand.

3. The reclosable package of claim 2 wherein the second gusset protrusion protrudes when the second gusset expands.

4. The reclosable package of claim 3 wherein the first gusset fold includes a line of weakness.

5. The reclosable package of claim 4 wherein the line of weakness provides tamper evidence.

6. The reclosable package of claim 5 wherein the line of weakness is a perforated line.

7. The reclosable package of claim 3 wherein an opening is provided in the first gusset fold.

8. The reclosable package of claim 4 wherein the first and second walls are formed from a single sheet of web.

9. A reclosable package comprising:

at least one sheet of web forming a first wall and a second wall;

a first gusset formed between the first wall and the second wall, thereby forming a first gusset fold between a first protrusion and a second protrusion;

a zipper including a first zipper profile attached to an interior of the first protrusion, a second zipper profile attached to an interior of the second protrusion;

a second gusset formed in the first wall thereby forming a second gusset fold and a second gusset protrusion; and wherein edges of the first wall and the second wall are brought together at a location opposite the first gusset, product is inserted between the edges of the first wall and the second wall, and a seal formed joining the edges of the first wall and the second wall, wherein the seal is sufficiently wide for at least one hang aperture to be formed therein.

10. The reclosable package of claim 9 wherein the second gusset expands when the reclosable package is filled with product thereby allowing the reclosable package to stand.

11. The reclosable package of claim 10 wherein the second gusset protrusion protrudes when the second gusset expands.

12. The reclosable package of claim 11 wherein the first gusset fold includes a line of weakness.

13. The reclosable package of claim 12 wherein the line of weakness provides tamper evidence.

14. The reclosable package of claim 13 wherein the line of weakness is a perforated line.

15. The reclosable package of claim 11 wherein an opening is provided in the first gusset fold.

16. The reclosable package of claim 12 wherein the first and second walls are formed from a single sheet of web.

* * * * *